US005723808A

United States Patent [19]

Devall

[11] Patent Number: 5,723,808

[45] Date of Patent: Mar. 3, 1998

[54] ADJUSTABLE REST

[76] Inventor: Jeffrey D. Devall, P.O. Box 8612, Clinton, La. 70722

[21] Appl. No.: 687,148

[22] Filed: Jul. 24, 1996

[51] Int. Cl.[6] ..... F41B 23/06

[52] U.S. Cl. ..... 89/37.04; 42/94; 248/124.1

[58] Field of Search ..... 42/94; 89/37.04, 89/37.14; 248/124.1, 122.1, 124.2, 125.1

[56] References Cited

U.S. PATENT DOCUMENTS

| | | | |
|---|---|---|---|
| 5,039,052 | 8/1991 | Cavafice | 248/309.1 |
| 5,275,364 | 1/1994 | Burger et al. | 248/122 |
| 5,491,920 | 2/1996 | McCullers | 42/94 |
| 5,595,333 | 1/1997 | Boston | 224/536 |

FOREIGN PATENT DOCUMENTS

| | | | |
|---|---|---|---|
| 402699 | 10/1909 | France | 42/94 |
| 565120 | 7/1957 | Italy | 248/124.1 |

*Primary Examiner*—Stephen M. Johnson
*Attorney, Agent, or Firm*—Warner J. Delaune

[57] ABSTRACT

An adjustable rest is provided, comprising a support base; a mounting strap for attaching the support base to a rigid structure, such as a tree, above the head of a user; a first support member slidably connected to the support base; a second support member pivotally connected to the first support member wherein the second support member can be pivoted about at least two axes; a third support member pivotally connected to the second support member, wherein the third support member is adjustable in length; and a resting device operatively connected to the third support member for allowing a selected device to be rested thereon. The resting device may comprise a device for holding a gun, an archery bow, a camera, video recording device, or the like.

4 Claims, 5 Drawing Sheets

ADJUSTABLE REST

BACKGROUND OF THE INVENTION

I. Field of the Invention

The present invention relates generally to supports used to provide a stable platform for selected devices, and more particularly to supports used by hunters to rest a gun, a bow, or other device thereon while positioned in a tree.

II. Description of Prior Art

In the sport of hunting, the key to success is unquestionably the ability of the hunter to accurately aim the weapon at his quarry. In turn, accurate aiming depends heavily on the prevention of excess movement of the weapon at the time of making the shot. Similarly, photographers require that the camera be relatively still in order to maintain focus and avoid undesirable blurring of the subject. Over the years, a variety of devices have been proposed which attempt to provide a stable base for a weapon or camera. Most of such devices have taken the form of a tripod which is supported by the ground or other surface on which the hunter or photographer is positioned. For example, the devices described in U.S. Pat. Nos. 4,913,391; 4,967,497; 5,149,900; and 5,287,643 are all supported in a plane below the person and provide support for guns and/or cameras.

For many sportsmen, including wildlife photographers, the object of their efforts is often sought from an elevated vantage point, such as a tree stand, to avoid detection by the animal. Unfortunately, such tree stands typically offer no more space than what is necessary to support the person and a hand-held weapon or camera. Although some of the devices listed above may possibly be attached to the tree stand itself, there are several disadvantages to doing so, even if such devices could be so adapted. For example, a fixed mount would be an inconvenient obstruction to the free movement of the hunter during the hunt. Likewise, such an obstruction would present a significant safety hazard in the event that the clothes of the hunter became entangled with the mount. Additionally, the structural connections required to fix the mount to the tree stand would likely prevent the mount from being adjustable enough to suit the needs of the situation.

Given the space constraints of a tree stand, a new rest for weapons, cameras, and the like is required which avoids the aforementioned problems and offers the flexibility and adjustability called for in a hunting or photographic environment. Specifically, the adjustable rest should be attachable directly to the tree or other support structure so that the limited space in the tree stand remains open for other purposes. Furthermore, the rest should be highly adjustable to accommodate a wide range of shooting directions. Finally, it should be positionable above the head of the hunter or photographer so that the user can easily move it aside when it is not needed, thereby providing an unobstructed view of the surroundings. Importantly, these criteria should be satisfied while not sacrificing any aspects of safety for the user.

SUMMARY OF THE INVENTION

It is therefore an object of this invention to provide an adjustable rest which can be manipulated in a variety of ways to provide an accurate and stable platform for a gun, a bow, a video recorder or other selected device.

It is also an object of this invention to provide an adjustable rest which is attachable to a tree or other rigid structure.

It is a further object of this invention to provide an adjustable rest which is positioned over the head of a user and which can be selectively moved into and out of an operative position.

Yet another object of this invention is to provide an adjustable rest which is lightweight and easily portable.

These and other objects and advantages of the present invention will no doubt become apparent to those skilled in the art after having read the following description of the preferred embodiment which are contained in and illustrated by the various drawing figures.

Therefore, in a preferred embodiment, an adjustable rest is provided, comprising a support base; mounting means for attaching said support base to a rigid structure, such as a tree; a first support member slidably connected to said support base; a second support member pivotally connected to said first support member wherein said second support member can be pivoted about at least two axes; a third support member pivotally connected to said second support member, wherein said third support member is adjustable in length; and resting means operatively connected to said third support member for allowing a selected device to be rested thereon. The resting means may comprise a means for holding a gun, an archery bow, a camera, video recording device, or the like.

DETAILED DESCRIPTION OF THE PREFERRED EMBODIMENTS

Figure 1A:
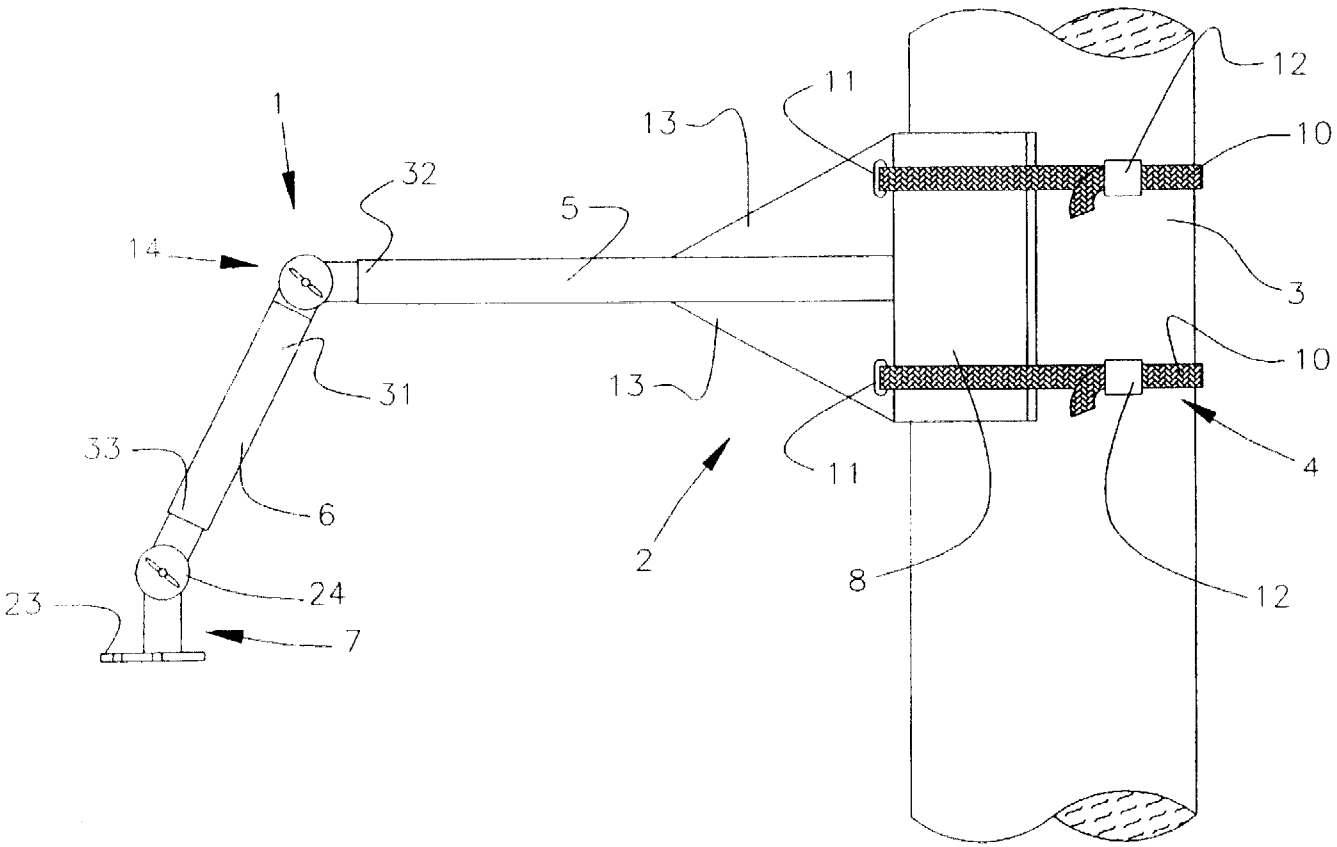
FIG. 1A is a side view of one embodiment of the adjustable rest.

In the drawings many details pertaining to fabrication and maintenance utility well established in the machine construction art and not bearing upon points of novelty are omitted in the interest of descriptive clarity and efficiency. Such details may include threaded connections, lockrings, shear pins, weld lines and the like.

Figure 1B:
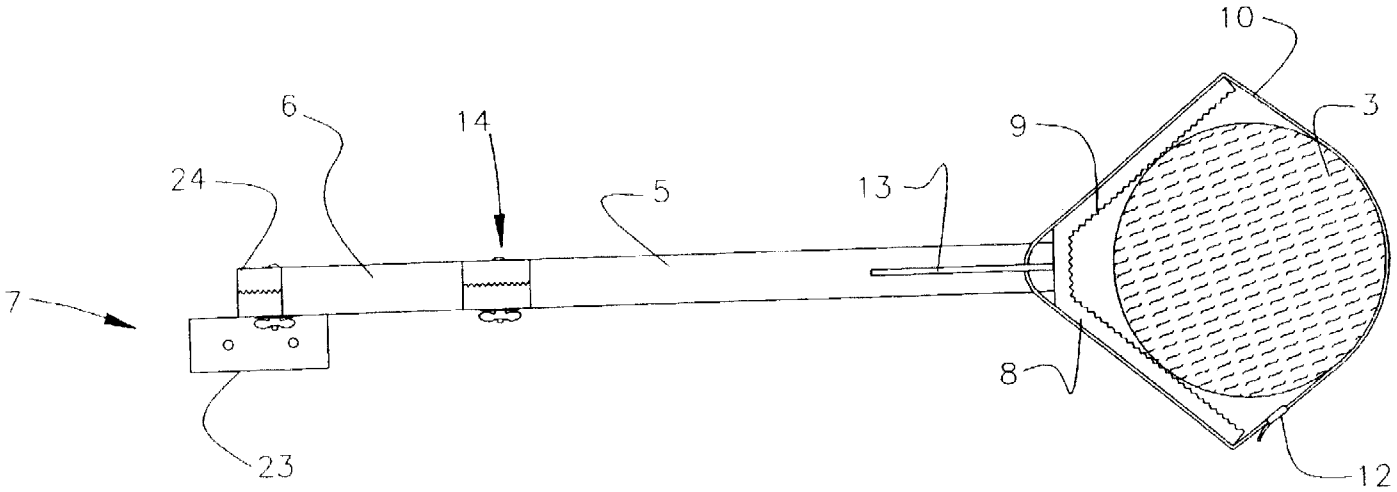
FIG. 1B is a top view of the adjustable rest of FIG. 1A.

Turning now to FIGS. 1A and 1B, a simplified embodiment 1 of the invention is shown to generally comprise a support base 2 which is attachable to any rigid structure, such as tree 3, by mounting means 4, a primary support member 5 rigidly connected to the support base 2, and a secondary support member 6 pivotally connected to the primary support member 5. Resting means 7 is also connected to the secondary support member 6 to allow a selected device to be rested thereon.

Support base 2 comprises a V-shaped portion 8 which is adapted to be placed against a tree 3. The V-shaped portion 8 includes a plurality of protrusions 9, best shown in FIG. 1B, which tend to grip the tree 3 when urged against it by the securing of mounting means 4. Mounting means 4 may simply comprise one or more straps 10 passed through an equal number of slots 11 formed into the support base 2 and which wrap around the tree 3. Each of the straps 10 includes a means for tightening the straps 10 around the tree 3, such as a quick-release buckle 12.

As shown in FIG. 1A, primary support member 5 is rigidly connected to support base 2 and is further reinforced by a pair of webs 13 extending from V-shaped portion 8 to primary support member 5. Secondary support member 6 is pivotally connected at its proximal end 31 to the distal end 32 of primary support member 5 by a first lockable pivot 14 so that secondary support member 6 can be rotated relative to primary support member 5 in at least one plane.

Figure 2:
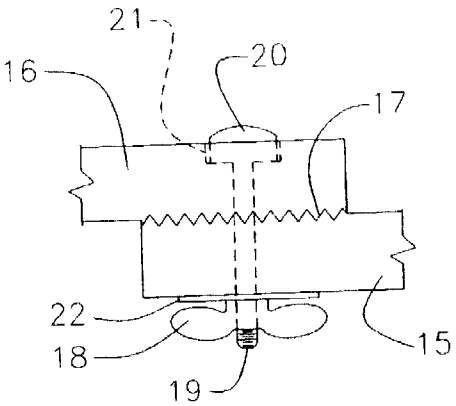
FIG. 2 is a detailed view of a pivoting connection employed by the present invention.

One example of the first lockable pivot 14 is shown in more detail in FIG. 2 and includes a pair of opposing and matable gripping members 15,16. Gripping member 15 is rigidly affixed to or made unitary with primary support member 5, while gripping member 16 is affixed to or made unitary with secondary support member 6. Each of gripping members 15,16 is circular in shape and includes a plurality of teeth 17 formed radially from the center of each gripping member 15,16. Gripping members 15,16 can be caused to prevent rotation of primary support member 5 relative to secondary support member 6 by the tightening of a wing nut 18 against a bolt 19 passed through both of gripping members 15,16. Bolt 19 may include a hexagonally shaped head 20 which is recessed within a similarly shaped cavity 21 formed into gripping member 16. A washer 22 may also be present beneath wing nut 18 to distribute forces to gripping member 15 during tightening. In order to rotate primary support member 5 relative to secondary support member 6, wing nut 18 is untightened so that gripping members 15,16 can be separated enough to disengage teeth 17 of both gripping members 15,16 from one another. Optionally, a helical spring (not shown) can be placed between gripping members 15,16 to urge separation of teeth 17, thereby greatly facilitating any necessary adjustments. It will be understood to those of ordinary skill that the aforedescribed lockable pivot 14 is readily available from a number of manufacturers and that such pivots can be attached to primary and secondary support members 5,6 or they can be molded as a unitary part of such members.

Resting means 7, in the form of an L-shaped video recorder adaptor plate 23 shown in FIGS. 1A and 1B, is connectable to the distal end 33 of secondary support member 6 by a second lockable pivot 24. Lockable pivot 24 is of the same construction as that shown in FIG. 2 and described with reference to lockable pivot 14 earlier herein. Video recorder adaptor plate 23 includes a hole pattern (threaded or unthreaded) 25 which matches the attachment holes on most available video recording devices, and it is one example of many different resting means 7 which are possible for use with the present invention.

Figure 3A:
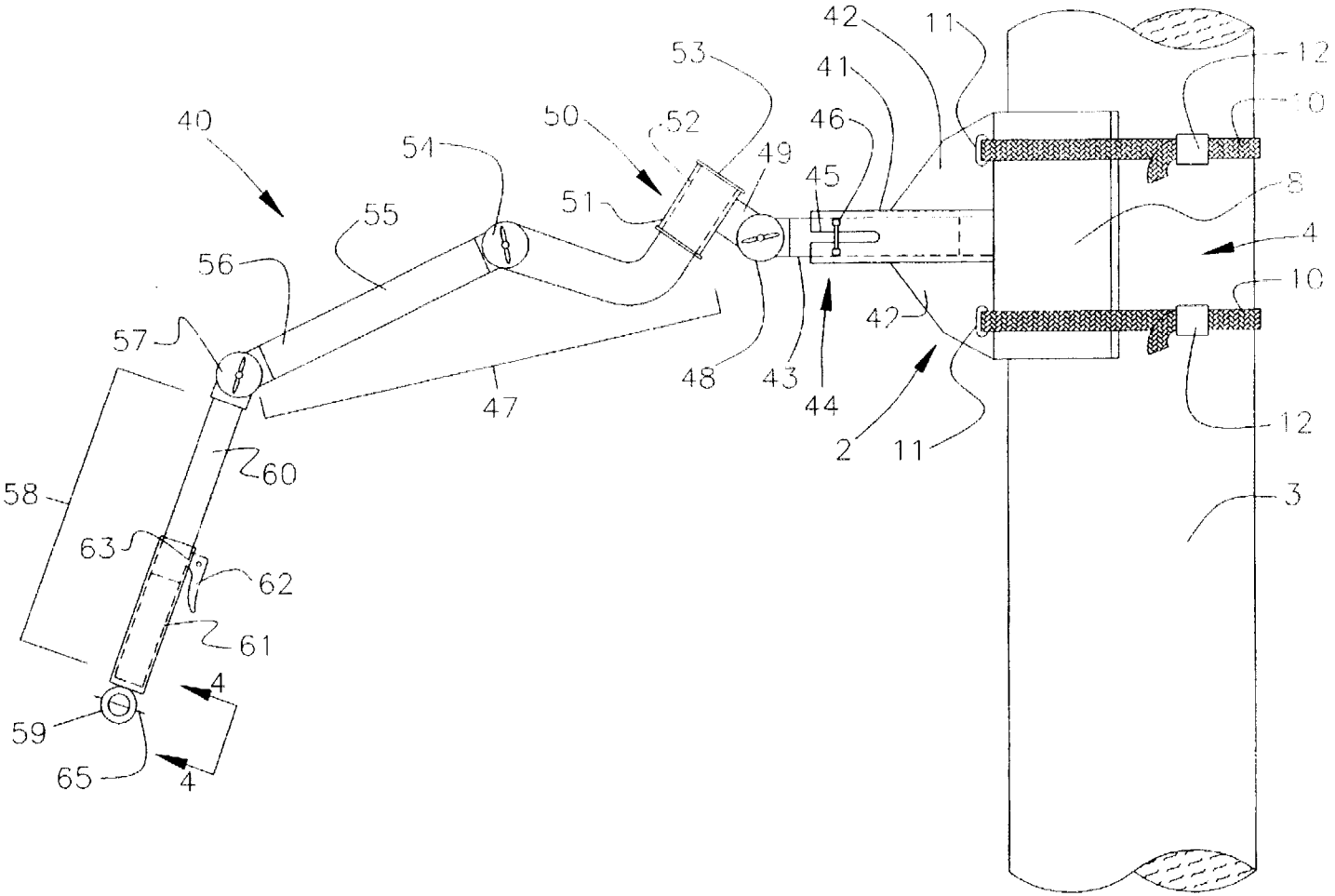
FIG. 3A is a side view of an alternate embodiment of the adjustable rest.
Figure 3B:
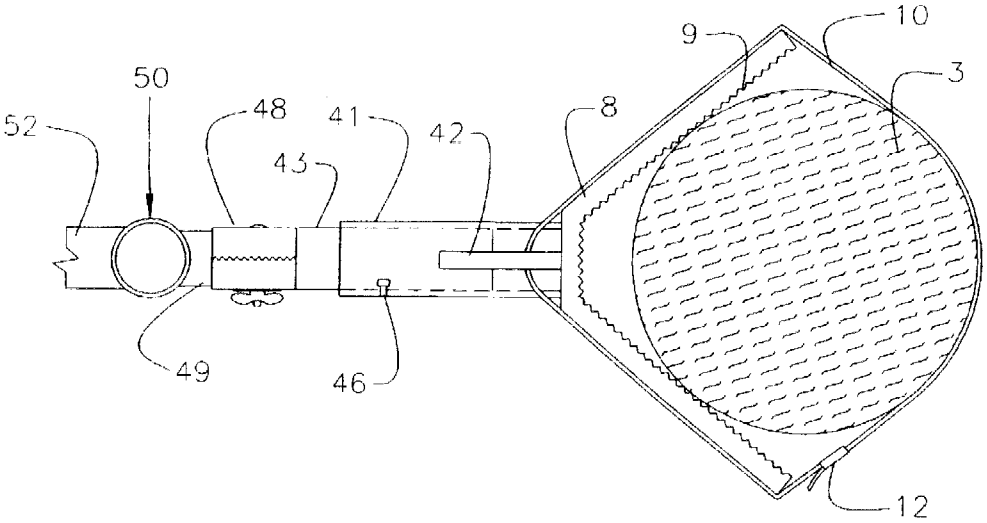
FIG. 3B is a partial top view of the alternate embodiment of FIG. 3A.

An alternate embodiment 40 of the present invention is shown in FIGS. 3A and 3B which provides greater adjustability and advantages over the first embodiment 1. The support base 2 and mounting means 4 of the alternate embodiment 40 are similar in most respects to those shown in FIGS. 1A and 1B. However, the support base 2 of this embodiment further includes a hollow tube member 41 rigidly affixed to V-shaped portion 8 and reinforced by webs 42. A first support member 43 of round cross-section is slidable within tube member 41 and has an outside diameter closely matched to the inside diameter of tube member 41. Therefore, first support member 43 is capable of rotation within tube member 41 about the longitudinal axis of tube member 41, as well as being capable of extension or retraction within tube member 41. This type of adjustability of first support member 43 is desirable in compensating for trees which are not perfectly vertical. The position of first support member 43 along the longitudinal axis of tube member 41, as well as the rotation angle of first support member 43, can be fixed by locking means 44. One version of locking means 44 includes one or more slots 45 formed into tube member 41 which can be urged to a closed position by a latch or buckle 46 attached to tube member 41 and positioned across slot 45. Depending upon the looseness of the fit between tube member 41 and first support member 43, a simple strap (not shown) having conventional hook and loop fasteners may also be sufficient to fix the position of first support member 43.

A second support member 47 is pivotally connected to first support member 43 so that second support member 47 can be pivoted about at least two axes. As shown in FIG. 3A, and working in a direction away from tree 3, second support member 47 is connected to first support member 43 by a first lockable pivot 48 identical to those described earlier. The far side 49 of lockable pivot 48 is affixed to a swing pivot 50 which allows rotation of the remainder of the invention about a substantially vertical axis. To provide rotation, swing pivot 50 is comprised of a collar portion 51 into which an L-shaped elbow portion 52 of second support member 47 resides. A cap 53 is permanently affixed to the top of elbow portion 52 to prevent second support member 47 from detachment from collar 51. Optionally, a second lockable pivot 54 may be present between elbow 52 and a sub-segment 55 of second support member 47 to provide further adjustability. However, second lockable pivot 54 may also be omitted, wherein sub-segment 55 and elbow 52 would comprise one continuous rigid member 47.

At the distal end 56 of second support member 47 (or sub-segment 55, if second lockable pivot 54 is employed), a third lockable pivot 57 is provided to connect a third support member 58. Third support member 58 may be of unitary construction and terminating in universal resting means adaptor 59, or it may be adjustable in length. If adjustable, third support member 58 is comprised of a stationary segment 60, which includes a mating half of third lockable pivot 57, and a movable segment 61 which is lockably slidable relative to stationary segment 60. One method of locking the movable segment 61 is provided by a hinged lever 62 attached to movable segment 61 wherein the hinged lever 61 includes a cam-type portion 63 capable of frictional contact with stationary segment 60. However, any means of conveniently locking the movable segment 61 to the stationary segment 60 would also be suitable.

Figure 4:
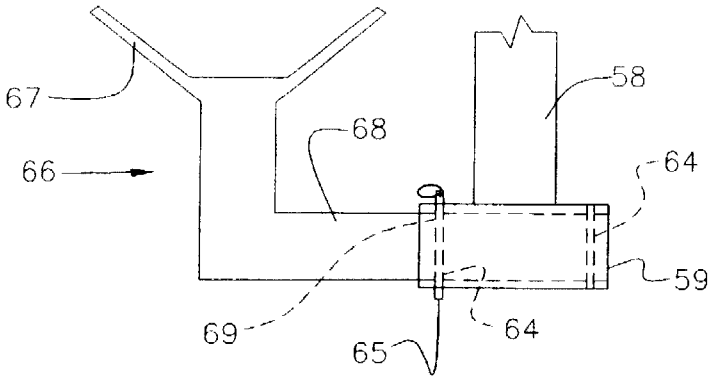
FIG. 4 is a side view of the universal adaptor with an attached rifle support.

The universal resting means adaptor 59 is simply a tube attached to third support member 58 which can be used to hold any number of resting devices. One or more holes 64 are formed through the tube so that a pin 65 can be inserted therethrough. For example, in FIG. 4, a rifle rest 66 is shown installed within resting means adaptor 59, wherein a V-shaped portion 67 is shaped to support a forestock of a rifle. A male portion 68 of the rifle rest 66 having at least one hole 69 formed therethrough is inserted into the adaptor 59 and locked in place by pin 65.

Figure 5:
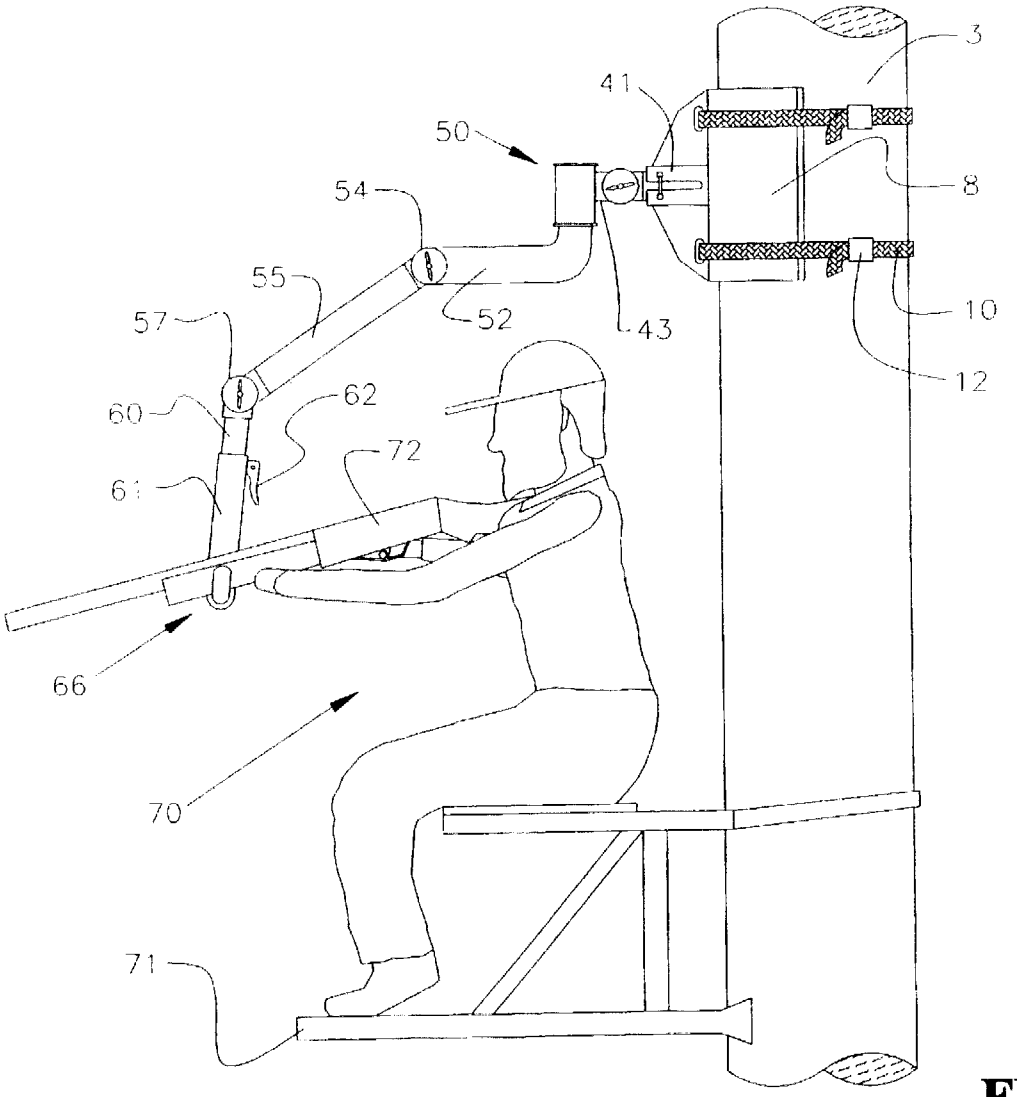
FIG. 5 is a side view of the invention in use by a hunter.

FIG. 5 depicts a slightly modified embodiment of the present invention installed onto a tree 3 and in use by a hunter. In this embodiment, the first lockable pivot 48 has been omitted to illustrate that the invention can be simplified by attaching the first support member 43 directly to the swing pivot collar 51 while still providing the swing-away features of the invention. As can be appreciated from FIG. 5, a hunter 70 is seated within a tree stand 71 and is using the rifle rest 66 in connection with the adjustable rest invention to aim a rifle 72 at a target (not shown). Once the height adjustments of the rest 66 are fine tuned using the cam lever 62, the hunter's rifle can be supported in a stable manner throughout a wide horizontal arc, thus minimizing discomfort and fatigue and maximizing the chances of making a successful shot.

Although the present invention has been described in terms of specific embodiments, it is anticipated that alterations and modifications thereof will no doubt become apparent to those skilled in the art. It is therefore intended that the following claims be interpreted as covering all such alterations and modifications as fall within the true spirit and scope of the invention.

I claim:

1. An adjustable rest, comprising:

(a) a support base;

(b) mounting means for attaching said support base to a rigid structure;

(c) a first support member slidably connected to said support base;

(d) a second support member pivotally connected to said first support member wherein said second support member can be pivoted about at least two axes and wherein said second support member includes a first portion and a second portion, and wherein said first portion and said second portion are pivotally connected to one another;

(e) a third support member pivotally connected to said second support member, wherein said third support member is adjustable in length; and (f) resting means operatively connected to said third support member for allowing a selected device to be rested thereon.

2. The adjustable rest of claim 1, wherein said resting means includes means for holding a gun.

3. The adjustable rest of claim 1, wherein said resting means includes means for holding a video recording device.

4. The adjustable rest of claim 1, wherein said resting means includes means for holding a bow.

* * * * *